US008931488B2

(12) United States Patent
Evans et al.

(10) Patent No.: US 8,931,488 B2
(45) Date of Patent: Jan. 13, 2015

(54) MOUTH GUARD WITH BREATHING AND DRINKING APERTURE

(71) Applicant: Battle Sports Science, LLC, Omaha, NE (US)

(72) Inventors: Michael Evans, Elkhorn, NE (US); Christopher W. Circo, Bennington, NE (US); Jeffrey M. Evans, Omaha, NE (US)

(73) Assignee: Battle Sports Science, LLC, Omaha, NE (US)

( * ) Notice: Subject to any disclaimer, the term of this patent is extended or adjusted under 35 U.S.C. 154(b) by 0 days.

(21) Appl. No.: 13/666,698

(22) Filed: Nov. 1, 2012

(65) Prior Publication Data

US 2013/0104913 A1 May 2, 2013

Related U.S. Application Data

(60) Provisional application No. 61/554,331, filed on Nov. 1, 2011.

(51) Int. Cl.
*A61C 5/14* (2006.01)
*A63B 71/08* (2006.01)

(52) U.S. Cl.
CPC ..... *A63B 71/085* (2013.01); *A63B 2071/086* (2013.01)
USPC ..... 128/861; 128/859

(58) Field of Classification Search
USPC ..... 128/848, 859–862, 201.27, 201.23, 128/201.11; 433/6–7; 2/421–422
See application file for complete search history.

(56) References Cited

U.S. PATENT DOCUMENTS

| | | | | | |
|---|---|---|---|---|---|
| 4,495,945 | A * | 1/1985 | Liegner | 128/200.26 |
| 4,664,109 | A * | 5/1987 | Rasocha | 128/207.14 |
| 4,825,881 | A * | 5/1989 | Bessler | 128/859 |
| 5,031,611 | A * | 7/1991 | Moles | 128/201.11 |
| 5,865,170 | A * | 2/1999 | Moles | 128/201.26 |
| 5,921,241 | A * | 7/1999 | Belfer | 128/848 |
| 6,675,804 | B1 * | 1/2004 | Pivovarov | 128/848 |
| 6,736,139 | B1 * | 5/2004 | Wix | 128/206.21 |
| 6,966,319 | B2 * | 11/2005 | Fitton | 128/848 |
| 7,785,514 | B2 * | 8/2010 | McCarthy | 264/245 |
| 2005/0236003 | A1 * | 10/2005 | Meader | 128/848 |

* cited by examiner

*Primary Examiner* — Alireza Nia
*Assistant Examiner* — Ophelia A Hawthorne
(74) *Attorney, Agent, or Firm* — Perkins Coie LLP

(57) ABSTRACT

A mouth guard includes a pair of spaced-apart molar receiving members with an inner wall extending therebetween. The inner wall is configured for insertion between a user's lips and teeth. An outer wall is configured to confront an exterior surface of the user's lips. A conduit extends between the inner and outer walls and includes a passage formed therethrough. The passage extends through the inner wall between the molar receiving members and extends through the outer wall whereby a user may breathe or drink through the passage.

10 Claims, 6 Drawing Sheets

MOUTH GUARD WITH BREATHING AND DRINKING APERTURE

CROSS-REFERENCE TO RELATED PATENT APPLICATIONS

This patent application claims priority to: U.S. Provisional Patent Application No. 61/554,331, entitled "Mouth Guard with Breathing and Drinking Aperture," filed Nov. 1, 2011, the contents of which is hereby incorporated by reference herein in its entirety.

BACKGROUND

Concussion, or mild traumatic brain injury (MTBI), is the most common type of traumatic brain injury. Sports-related concussions have increased over the years. This may be relative to the increased physical stature of athletes and the intensity of contact sports over time. Frequently defined as a head injury with a temporary loss of brain function, concussion can cause a variety of physical, cognitive, and emotional symptoms.

The human body generally is built to protect the brain from traumatic injury. Cerebrospinal fluid surrounds the brain beneath the skull. The skull provides the hardened exterior protection, while the cerebrospinal fluid provides a hydraulic "cushion" that protects the brain from light trauma. However, severe impacts or forces associated with rapid acceleration and deceleration may not be absorbed by this cushion. As they are understood, however, concussions are likely caused by impact forces, in which the head strikes or is struck by an object. In other instances, concussion may be caused by impulsive forces, in which the head moves without itself being subject to blunt trauma, such as in the case of severe whiplash.

Concussive forces may engage an individual's head in a manner that causes linear, rotational, or angular movement of the brain. In rotational movement, the head turns around its center of gravity, and in angular movement it turns on an axis not through its center of gravity. Concussions and their proximate causation remain the center of study and debate. However, it is generally accepted that the threshold amount of blunt force for concussion is approximately 70-75 g. Impacts to the individual's head of this magnitude and greater are thought to adversely affect the midbrain and diencephalon. The forces from the injury are believed to disrupt the normal cellular activities in the reticular activating system located in these areas. Such disruption may produce loss of consciousness, which often occurs in concussion injuries.

The prior art has produced a wide array of protective equipment, such as helmets, mouth guards, and other headgear in an attempt to reduce the number of sports-related concussions. In particular, mouth guards are believed to help prevent concussions as well as protect the user's teeth from damage. Traditionally, mouth guards have been formed of plastic or rubber and engage a user's upper and lower teeth to keep the guard in position. These traditional mouth guards have a tendency to obstruct the user's mouth opening. Accordingly, they obstruct breathing through the mouth, which is required for heavy breathing during athletic exertion. Similarly, they inhibit drinking when placed in a user's mouth. Thus, there is a need for an effective mouth guard that allows for air flow through a user's mouth. There is a further need for a mouth guard that allows a user to drink while wearing the mouth guard.

SUMMARY

This Summary is provided to introduce a selection of concepts in a simplified form that are further described below in the Detailed Description. Neither this Summary, nor the foregoing Background, is intended to identify key aspects or essential aspects of the claimed subject matter. Moreover, this Summary is not intended for use as an aid in determining the scope of the claimed subject matter.

Described herein is a mouth guard that comprises a pair of spaced apart molar receiving members; an inner wall extending between the molar receiving members and configured for insertion between a user's inner lip and teeth; an outer wall configured to confront the user's outer lip; and a conduit extending between the inner and outer walls including a passage formed therethrough that extends through the inner wall between the molar receiving members and through the outer wall whereby a user may breath or drink through the passage.

In various embodiments, the molar receiving members include a plurality of ribs, that extend from opposite upper and lower biting surfaces, which provide grip and stability. The molar receiving members may also include retaining walls that extend above and below the upper and lower biting surfaces of the molar receiving members to maintain the mouth guard in place.

The outer wall includes a rearward surface that confronts the user's lips and has a spherical shape that generally conforms to the user's lips. In some embodiments, the outer wall includes an aperture that may be used to attach a strap.

In at least one method of use, a user would position the mouth guard in their mouth such that molar receiving members are received between the user's molars, or back teeth, such that the teeth are disposed between retaining wall and inner wall. The user's lips are disposed over the forward surface of the inner wall. Accordingly, the user's lips are located between inner wall and outer wall. Therefore, conduit extends between the user's lips whereby the user may breathe or drink through a passageway while the mouth guard is in place. In some embodiments, the outer wall is resiliently deformable with a thickness sufficient to absorb, or otherwise deflect, impacts.

These and other aspects of the present system and method will be apparent after consideration of the Detailed Description and Figures herein.

DRAWINGS

Non-limiting and non-exhaustive embodiments of the mouth guard, including the preferred embodiment, are described with reference to the following figures, wherein like reference numerals refer to like parts throughout the various views unless otherwise specified.

DETAILED DESCRIPTION

Figure 1:
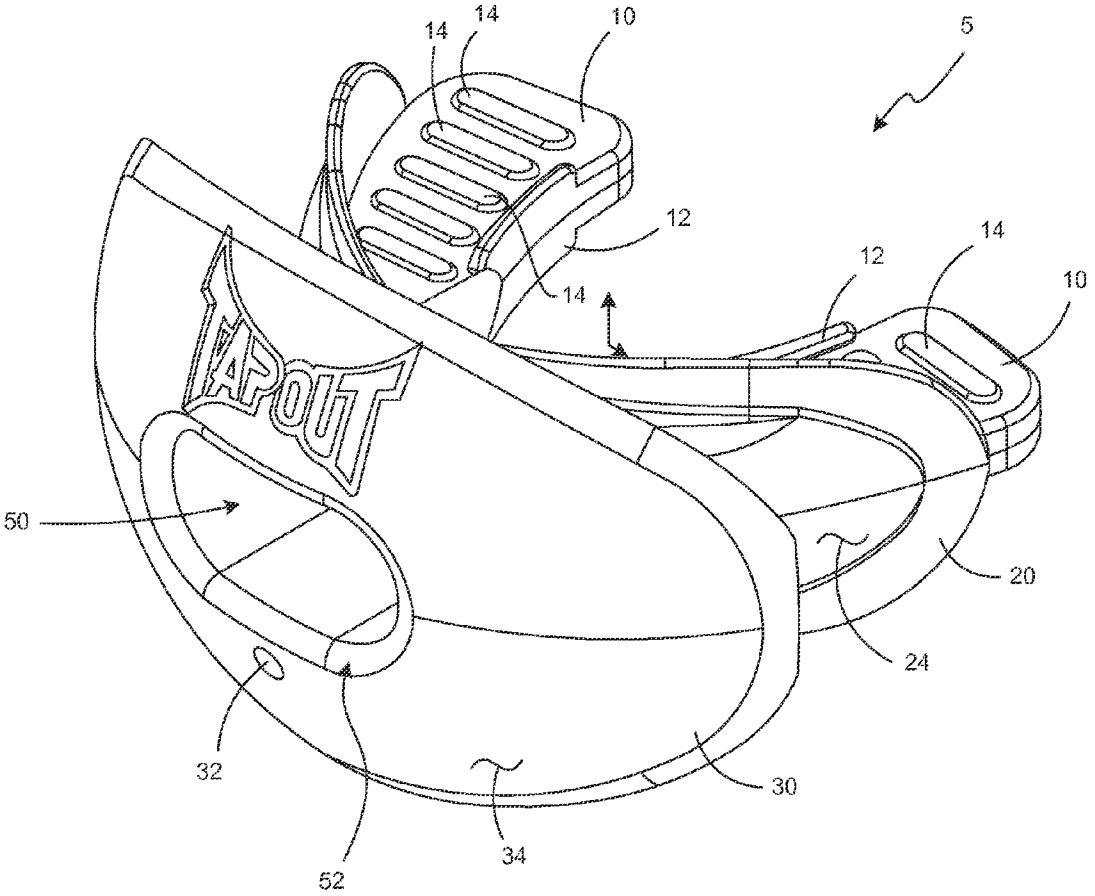
FIG. 1 is a perspective view of a mouth guard according to an exemplary embodiment as viewed from the front and top.
Figure 2:
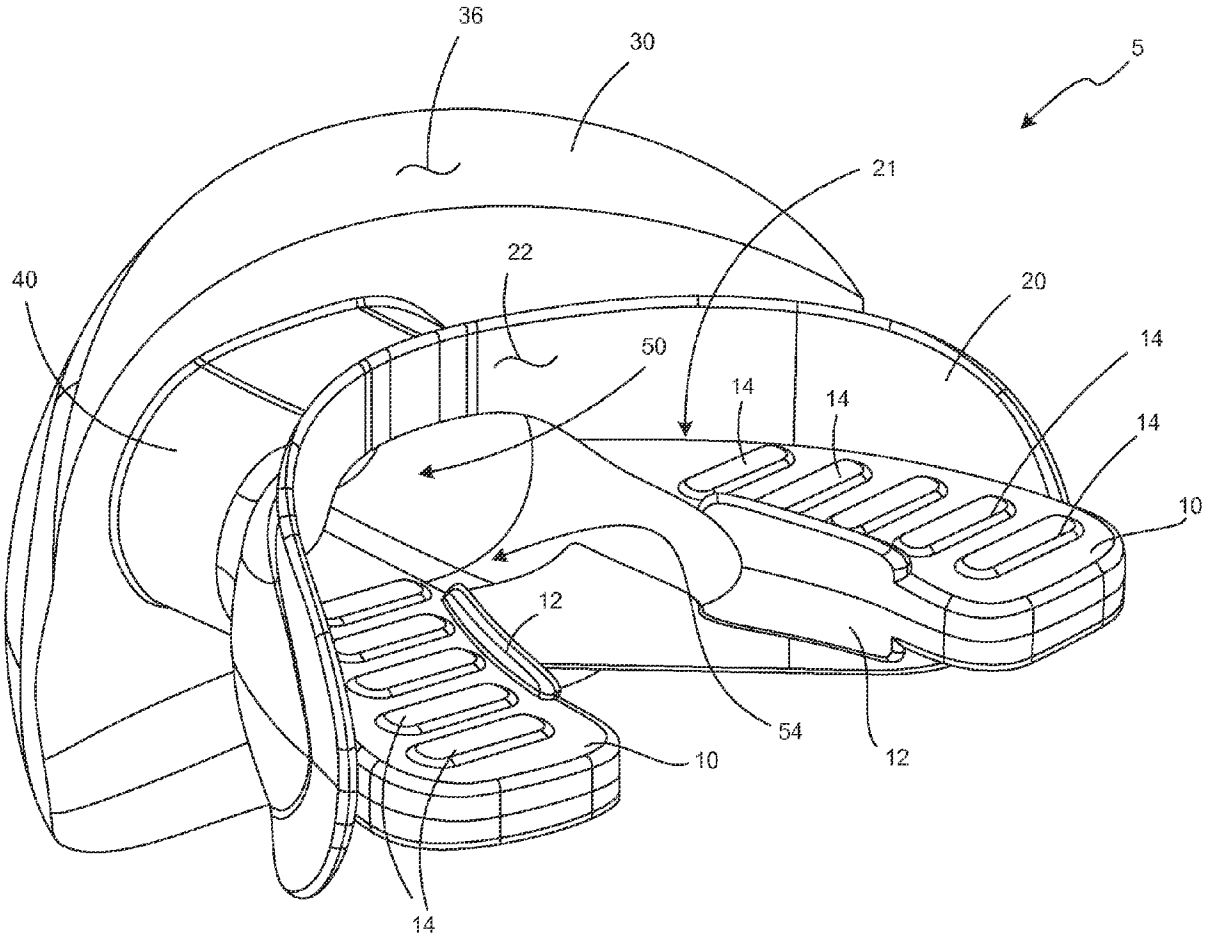
FIG. 2 is a perspective view of the mouth guard shown in FIG. 1 as viewed from the top and rear.
Figure 3:
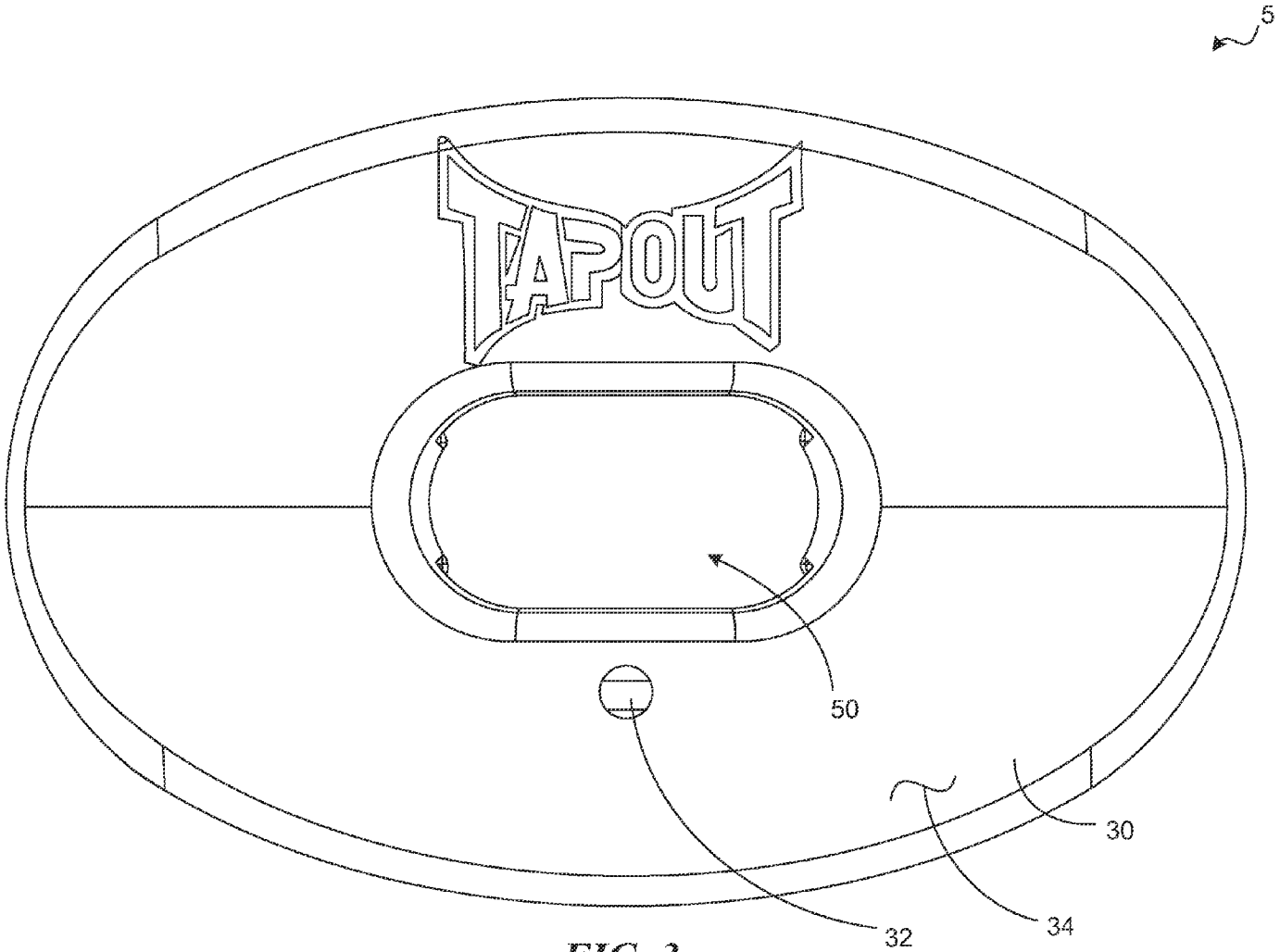
FIG. 3 is a front view in elevation of the mouth guard shown in FIGS. 1 and 2.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

With reference to FIGS. 1-6, mouth guard 5 is comprised of a pair of spaced-apart molar receiving members 10 with an inner wall 20 extending therebetween. Inner wall 20 is configured for insertion between a user's lips and teeth. An outer wall 30 is configured to confront an exterior surface of the user's lips. Conduit 40 extends between the inner and outer walls and includes a passage 50 formed therethrough between a forward opening 52, which penetrates the outer wall 30, and a rearward opening 54, which penetrates the inner wall 20. Passage 50 extends through the inner wall 20 between the molar receiving members 10 and extends through the outer wall 30 whereby a user may breathe or drink through passage 50.

Figure 4:
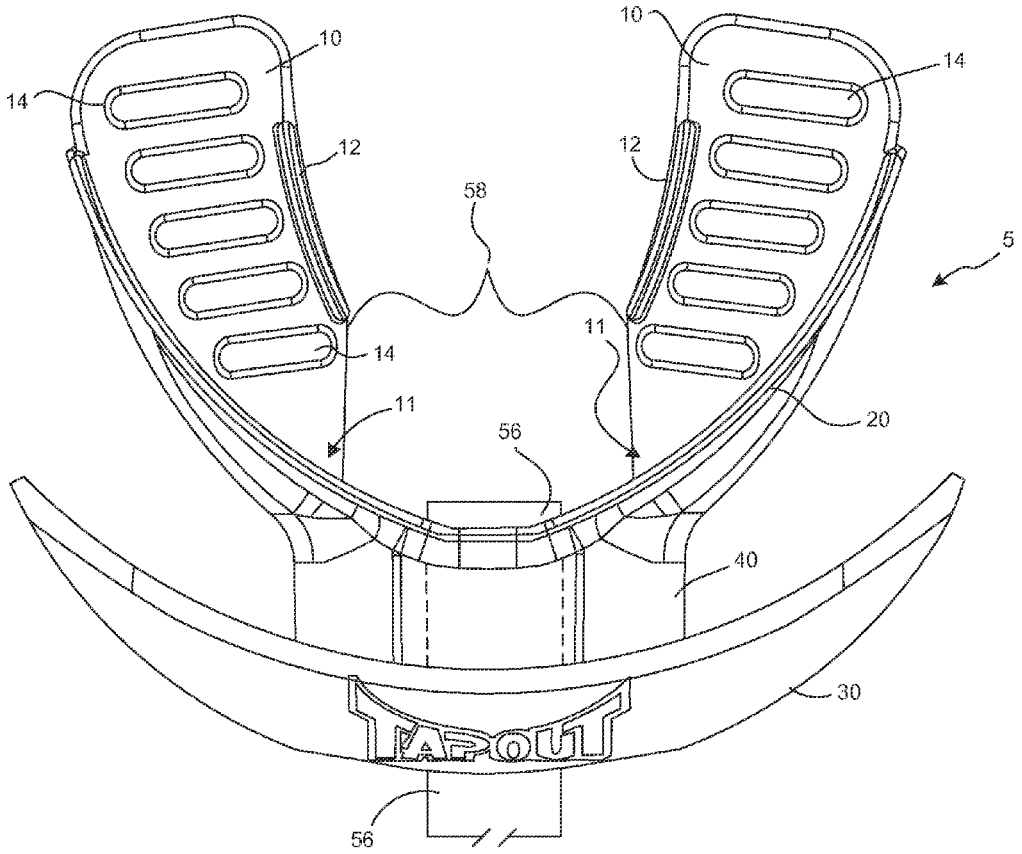
FIG. 4 is a top plan view of the mouth guard shown in FIGS. 1-3.
Figure 5:
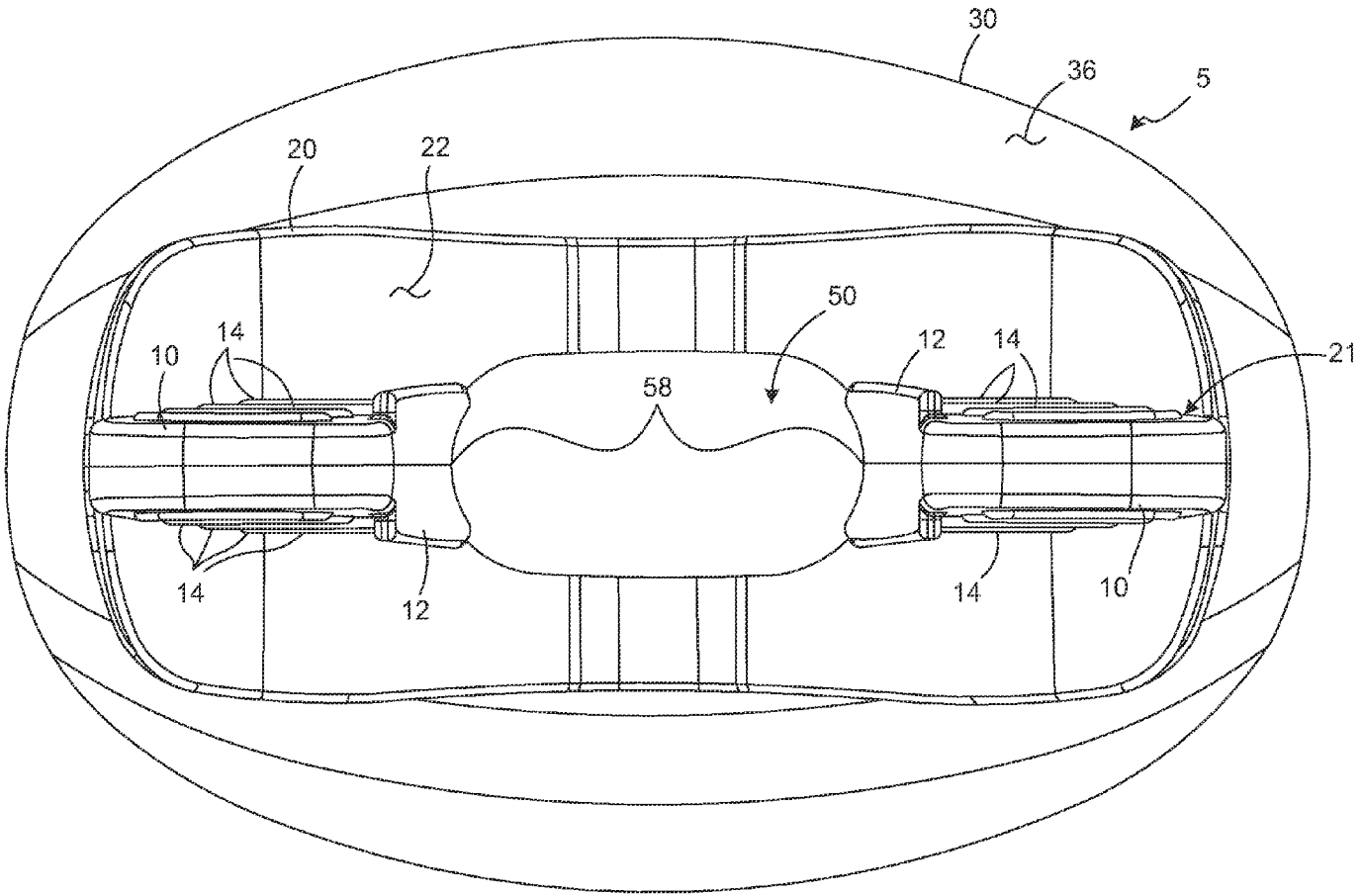
FIG. 5 is a rear view in elevation of the mouth guard shown in FIGS. 1-4.
Figure 6:
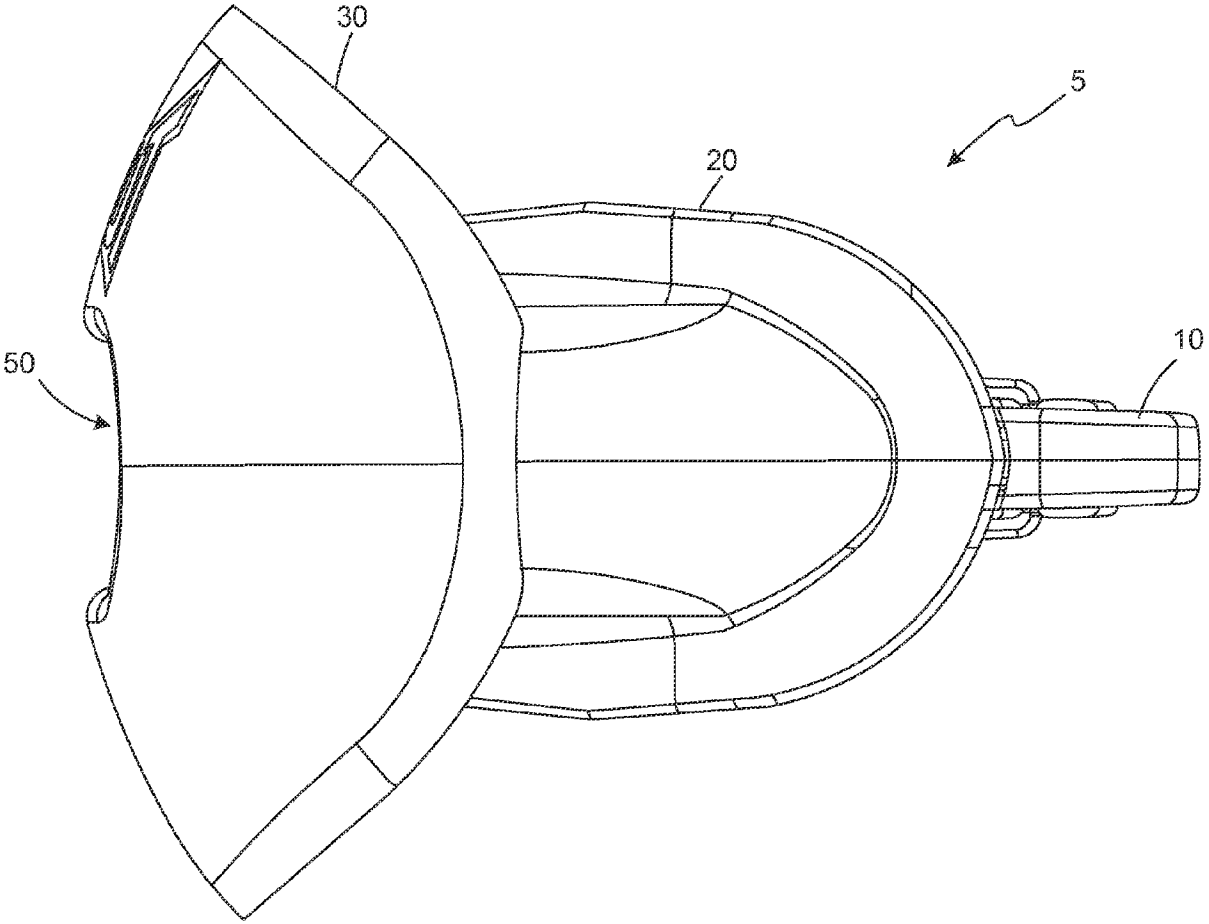
FIG. 6 is a side view in elevation of the mouth guard shown in FIGS. 1-5.

Molar receiving members 10 include a plurality of ribs 14, extending from opposite upper and lower biting surfaces, which provide grip and stability. Molar receiving members 10 also include retaining walls 12. As shown in the figures, retaining wall 12 may extend above and below the upper and lower biting surfaces of the molar receiving members 10. Accordingly, retaining wall 12 helps to maintain the mouth guard in place, resisting lateral movement of the mouth guard within the user's mouth. Retaining walls 12 confront the inner surface of a user's teeth. It should be appreciated from the figures that the pair of molar receiving members 10 are mirror images of each other. Also, it can be appreciated from the figures, and perhaps is best shown in FIG. 4, that molar receiving members extend generally along an arc which would follow the curvature of the user's upper and lower arcades of teeth. With reference to FIG. 5, it can be appreciated that each molar receiving member 10 includes a plurality of ribs 14 disposed on both the upper and lower surfaces thereof. Forward end portions 11 of the molar receiving members are positioned in a spaced-apart relationship with one another, defining a fluid gap 58, such that the mouth guard does not include biting surfaces for incisor teeth within upper and lower arcades of the user's teeth. With reference to FIG. 4, the fluid gap 58 has a width, along an entire length of the fluid gap 58, that is wider than a width of the passage 50 such that fluid may flow along a linear pathway, which is coaxial with the passage 50, from the rearward opening 54 passage 50, through the fluid gap 58, without confronting an opposing surface of the molar receiving members 10. Accordingly, the open passage that extends through opposite end portions of the conduit is unobstructed, such that a continuous fluid pathway is defined from the outer wall of the mouth guard through the fluid gap 58.

Inner wall 20 extends between the molar receiving members 10, and in this case, extends around the majority of the outer edge portion 21 of the molar receiving members 10. In various embodiments, the inner wall 20 is provided with a height of approximately 1.06 inches. Accordingly, inner wall 20 extends arcuately between the molar receiving members 10. Inner wall 20 includes a rearward surface 22 that confronts the user's teeth. Inner wall 20 also includes a forward surface 24 that confronts an inner surface of the user's lips. Conduit 40 extends between the forward surface 24 of the inner wall 20 and the rearward surface 36 of outer wall 30.

Outer wall 30 includes a forward surface 34 and a rearward surface 36 that confronts the user's lips. Outer wall 30 has a spherical shape that generally conforms to the user's lips. In various embodiments, the outer wall 30 is provided with a width of approximately 3.25 inches and an approximate height of 1.81 inches. It can be appreciated from the figures that the passageway 50 extends through the outer wall 30, through conduit 40, and through inner wall 20. Passage 50 extends through inner wall 20 between the molar receiving members 10. Outer wall 30 also includes an aperture 32 which may be used to attach a strap.

In this case, the forward opening 52 and rearward opening 54 for passage 50 are configured as obround apertures through the outer wall 30 and inner wall 20. The obround shape is positioned so that a long axis of the shape extends generally parallel to the upper and lower arcades of teeth and the short axis extends perpendicular to the upper and lower arcades of teeth. Accordingly, the size of the passageway is maximized to allow airflow for athletic exertion while limiting the distance that the user's jaw must remain open to accommodate the conduit 40 passage 50. In various embodiments, the forward opening 52 and rearward opening for passage 50 are provided with approximate widths of 1.06 inches and approximate heights of 0.56 inches. In such embodiments, the length of the passage 50 may approximate 0.81 inches. Although shown as obround in this case, the forward opening 52 and rearward opening 54 for passage 50 could be, for example and without limitation, oval, round, or rectangular, to name a few shapes.

In use, a user would place mouth guard 5 in their mouth such that molar receiving members 10 are received between the user's molars, or back teeth, such that the teeth are disposed between retaining wall 12 and inner wall 20. The user's lips are disposed over the forward surface 24 of the inner wall 20. Accordingly, the user's lips are located between inner wall 20 and outer wall 30. Therefore, conduit 40 extends between the user's lips whereby the user may breathe through passageway 50 even while mouth guard 5 is in place. Furthermore, a user may draw fluids through passage 50 while breathing or taking a drink with a typical athletic squeeze bottle by inserting the straw 56 at least partially through passage 50. Outer wall 30 protects the user's lips against impact which might otherwise pinch the user's lips against inner wall 20. In various embodiments, the outer wall 30 is provided to be resiliently deformable with a thickness sufficient to absorb, or otherwise deflect, impacts. Accordingly, the user's lips are protected by outer wall 30 which acts as a shield to prevent such pinching.

The mouth guards described herein may be formed of a suitable rubber or plastic materials as are known in the art. For example and without limitation, the mouth guard may be formed from thermoplastic elastomer (TPE) or ethylene vinyl acetate (EVA) or a combination thereof. The mouth guard may be formed by any suitable manufacturing process, such as for example injection molding, insert molding, welding, gluing, and the like. In addition, the mouth guards described herein may be decorated within mold labeling and in mold decorating techniques, as are known in the art.

Although the structures, technology, and methods of using and/or applying the same have been described in language that is specific to certain structures, materials, and methodological steps, it is to be understood that the present mouth guard is not necessarily limited to the specific structures, materials, and/or steps described. Rather, the specific aspects and steps are described as forms of implementing the disclosed mouth guard. Many embodiments can be practiced without departing from the spirit and scope of the mouth guard described herein. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A mouth guard comprising:

a pair of planar, spaced-apart molar receiving members; the molar receiving members having opposite upper and lower biting surfaces; forward end portions of the molar receiving members being positioned in a spaced-apart relationship with one another, defining a fluid gap, such that the mouth guard does not include biting surfaces for incisor teeth within upper and lower arcades of a user's teeth;

an outer wall having opposing forward and rearward surfaces; the rearward surface of the outer wall being shaped to confront an exterior surface of the user's lips;

an inner wall, positioned between the molar receiving members and the outer wall; the inner wall being shaped to extend along at least a substantial length of an outer edge portion of the molar receiving members and spanning the fluid gap between the molar receiving members; the inner wall having opposing forward and rearward surfaces; the forward surface of the inner wall being shaped to confront an inner surface of the user's lips; the rearward surface of the inner wall being shaped to confront forward surfaces of the user's teeth; and a conduit extending between the inner and outer walls; the conduit having an open passage that extends through opposite end portions of the conduit; the opening passage penetrating the inner and outer walls and positioned to be in open fluid communication with the fluid gap the conduit having an outer circumferential surface having a longitudinal length such that the forward surface of the inner wall is longitudinally separated from the rearward surface of the outer wall by a gap defined by the outer circumferential surface of the conduit extending between the inner and outer wall;

the fluid gap having a width, along an entire length of the fluid gap, that is wider than a width of the open passage such that fluid may flow along a linear pathway, which is coaxial with the open passage, from opposite end portions of the conduit passage at the inner wall, through the fluid gap without confronting an opposing surface of the molar receiving members.

2. The mouth guard of claim 1 wherein: the conduit passage opening, associated with one end portion of the conduit and the outer wall is configured as an obround aperture.

3. The mouth guard of claim 1 wherein: the rearward surface of the outer wall has a spherical shape that generally conforms to the user's lips; the outer wall being resiliently deformable and positioned to displace, absorb, or deflect energy from impacts against the user's lips.

4. The mouth guard of claim 1 further comprising:

a plurality of ribs extending from opposite upper and lower biting surfaces of the molar receiving members.

5. The mouth guard of claim 1 further comprising:

separate retaining walls that extend above and below the upper and lower biting surfaces of the molar receiving members, along opposite sides of the molar receiving members; the retaining walls terminating at, and not spanning, the fluid gap.

6. The mouth guard of claim 1 wherein: the open passage that extends through opposite end portions of the conduit is unobstructed such that a continuous fluid pathway is defined from the outer wall of the mouth guard through the fluid gap.

7. The mouth guard of claim 1 wherein:

a forward surface of the outer wall has a convex shape that is positioned to absorb or deflect impacts against the user's lips.

8. A method for passing fluid through a mouth guard, the method comprising:

positioning a mouth guard within a user's mouth such that:

a pair of planar, spaced-apart molar receiving members of the mouth guard are disposed between opposing molars in a user's mouth; opposite upper and lower biting surfaces of the molar receiving members confronting the opposing molars; forward end portions of the molar receiving members being positioned in a spaced-apart relationship with one another, defining a fluid gap, such that opposing incisors in the user's mouth do not confront biting surfaces;

an outer wall of the mouth guard is positioned so that a rearward surface of the outer wall confronts an exterior surface of the user's lips;

an inner wall of the mouth guard, positioned between the molar receiving members and the outer wall, being shaped to extend along at least a substantial length of an outer edge portion of the molar receiving members and spanning the fluid gap between the molar receiving members, is positioned so that a forward surface of the inner wall confronts an inner surface of the user's lips and a rearward surface of the inner wall confronts forward surfaces of the user's molars and incisors;

a conduit of the mouth guard extends between the inner and outer walls of the mouth guard and between upper and lower teeth of the user; the fluid gap having a width, along an entire length of the fluid gap, that is wider than a width of a rearward opening of the conduit passage that extends through opposite end portions of the mouth guard conduit the conduit having an outer circumferential surface having a longitudinal length such that the forward surface of the inner wall is longitudinally separated from the rearward surface of the outer wall by a gap defined by the outer circumferential surface of the conduit extending between the inner and outer wall; and directing fluid through the open conduit passage, and into the user's mouth such that the fluid flows along a linear pathway, which is coaxial with the open passage, from the rearward opening of the conduit passage, through the fluid gap, without confronting an opposing surface of the molar receiving members.

9. The method of claim 8 further comprising:

positioning an end portion of a straw in open fluid communication with the open conduit passage such that the straw does not contact lips of the user; and directing fluid through the straw, the open conduit passage, and into the user's mouth while the mouth guard is positioned within the user's mouth.

10. The method of claim 8 further comprising:

positioning an end portion of a drinking container closely adjacent to the open conduit passage; and directing fluid from the drinking container, through the open conduit passage, and into the user's mouth while the mouth guard is positioned within the user's mouth.

* * * * *